United States Patent [19]

Morikawa

[11] 4,401,857

[45] Aug. 30, 1983

[54] MULTIPLE SPEAKER

[75] Inventor: Eiji Morikawa, Neyagawa, Japan

[73] Assignee: Sanyo Electric Co., Ltd., Moriguchi, Japan

[21] Appl. No.: 323,093

[22] Filed: Nov. 19, 1981

[51] Int. Cl.[3] ..... H04R 17/00; H04R 17/06

[52] U.S. Cl. ..... 179/110 A; 179/116; 179/115.5 PS; 310/320; 310/321

[58] Field of Search ..... 179/110 A, 115.5 PS, 179/116, 132, 139, 1 D; 310/311, 366, 321, 322, 320, 331, 364; 367/155, 161, 163

[56] References Cited

U.S. PATENT DOCUMENTS 1,965,405 7/1934 Blattner ..... 179/115.5 PS 4,283,605 8/1981 Nakajima ..... 179/110 A

*Primary Examiner*—G. Z. Rubinson

*Assistant Examiner*—Danita R. Byrd

*Attorney, Agent, or Firm*—Darby & Darby

[57] ABSTRACT

A piezoelectric cone-type speaker having a multiple structure in which a plurality of piezoelectric elements and speaker diaphragms individually coupled to them are coaxially or multi-axially arranged. It has a wide frequency range. A cushioning member is interposed between one diaphragm and another so that each element is isolated from the vibrations of another element.

16 Claims, 11 Drawing Figures

MULTIPLE SPEAKER

BACKGROUND OF THE INVENTION (1) Field of the Invention

The present invention relates to a multiple speaker which is of piezoelectric type in its mode of drive and which is of cone type in its mode of radiation.

(2) Description of the Prior Art

The piezoelectric speaker is known as a high-frequency sound reproducing speaker. FIG. 1 is a schematic illustration in section of a piezoelectric speaker of conventional type, which has a disc-shaped piezoelectric element 91 comprising a metal base 911 and a piezoelectric material 912 bonded thereto. The element 91 is flexed when acoustic signals are applied between the metal base 911 and electrodes (not shown) disposed on the face of the piezoelectric material 912. A speaker diaphragm (paper cone) 92 having its smaller opening connected to the face of the piezoelectric element 91 at the center thereof generates sound when it is subjected to vibration due to flexing of the piezoelectric element 91. The larger opening of the speaker diaphragm 92 is peripherally secured to the peripheral edge of a speaker frame 93 having a saucer shape. A cushioning member 94 such as urethane foam is interposed between the underside of the piezoelectric element 91 or metal base 911 and the bottom of the frame 93 so that the transducing unit consisting of piezoelectric element 91 and speaker diaphragm 92 is softly held in position by the frame 93.

FIG. 2 shows by way of example the frequency response of a conventional piezoelectric speaker having the above described construction and whose piezoelectric element conforms to the following specifications:

Outer diameter: 21 mm
Thickness: 230 μm
Resonant frequency: 3.85 kHz
Resonant resistance: 150Ω or below
Electrostatic capacity: 90 nF The outer diameter of the cone (at its larger opening) is 40 mm.

As can be clearly seen from the figure, the frequency range available for sound reproduction is generally narrow. In order to obtain sound reproduction of a wider range, therefore, it is necessary to employ a plurality of piezoelectric speakers with their respective piezoelectric elements different in diameter from one another. This may be explained by the fact that a reproducing frequency range is governed by the resonant frequency of the element, while said resonant frequency is inversely proportional to the diameter of the element.

OBJECTS OF THE INVENTION

One of the objects of the present invention is to provide a multiple speaker of piezoelectric type having a wide range for sound reproduction.

It is another object of the invention to provide a multiple speaker which is simple in construction, compact and light in weight.

It is a further object of the invention to provide a multiple speaker which requires no speaker frame and which is so light as to permit diversification of component layout and mode of speaker use in audio apparatuses or instruments.

It is a still further object of the invention to provide a multiple speaker whose acoustic image is clear.

It is another object of the invention to provide a multiple speaker having good phase characteristics.

Other and further objects and novel features of the invention will become apparent from the following detailed description taken in connection with the accompanying drawings.

DETAILED DESCRIPTION OF THE INVENTION

The basic feature of the present invention is such that a plurality of transducing units, each comprising a speaker diaphragm (cone) having a diameter different from that of its counterpart in another unit and a piezoelectric element connected to the smaller end of the diaphragm, are coaxially or biaxially or multi-axially arranged, one upon another, with a cushioning member interposed between each two adjacent elements.

Figure 3:
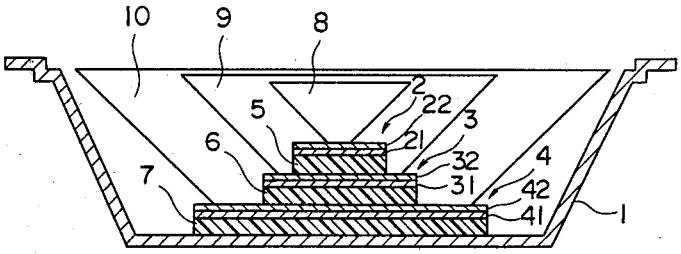
FIG. 3 is a schematic sectional view showing an embodiment of the present invention using disc-shaped piezoelectric elements.

Referring first to the embodiment of the invention shown in FIG. 3, piezoelectric disc-elements 2, 3, 4 having small, medium and large diameters respectively are concentrically placed one upon another, with cushioning members 5, 6 interposed, one between piezoelectric elements 2 and 3 and the other between elements 3 and 4. Each elements 2, 3, 4 is of such known type that it comprises a metal base (21, 31, 41) and a thin sheet of piezoelectric material (22, 32, 42) bonded to it, with electrodes (not shown) disposed on the piezoelectric material over a limited or the whole surface area thereof. The backside of the large-diameter element 4 is concentrically fixed to the inner bottom of a saucer-shaped speaker frame 1, with a cushioning member 7 placed between. Said cushioning member may be urethane foam, for example. The cushioning members 5, 6 and 7 are so sized as to have same diameters as piezoelectric elements 2, 3 and 4 respectively. Therefore, the peripheral edge portions of the piezoelectric elements 3 and 4 are exposed and not covered with the cushioning member 5, 6. To these peripheral edge portions are acoustically connected medium and large speaker diaphragms 9 and 10 at their respective smaller ends or openings. Similarly, a small speaker diaphragm 8 is acoustically connected at its smaller opening to the element 2. In the embodiment shown, the individual diaphrams 8, 9, 10 are coaxially arranged. The cushioning member 5, 6, 7 are joined by an adhesive to the elements 2, 3, 4 respecitvely and likewise, the cushioning member 7 to the speaker frame 1. The small diaphragm 8, positioned innermost, is not necessarily a truncated one as shown; if desired, it may be of full cone shape, in which case it is connected at its apex to the element 2. This equally applies to the innermost diaphragms (cones) in other embodiments to be described hereinafter.

In the above described arrangement, the three transducing units, which individually comprise piezoelectric elements 2, 3, 4 and speaker diaphragms 8, 9, 10 connected thereto respectively, are acoustically insulated from one another by means of cushioning member 5, 6; likewise, they are insulated from the speaker frame 1 by means of cushioning member 7. Accordingly, the piezoelectric elements 2, 3, 4 or the three transducing units produce vibrations of their inherent modes, exhibiting frequency responses of the band widths which correspond to the resonant frequencies of the individual elements 2, 3 and 4. A speaker having a wide band as a whole can be thus obtained. Needless to say, a larger-diameter piezoelectric element reproduces sound of lower frequency zone and a smaller-diameter element reproduces sound of high frequency zone. Also, it is noted that in the above described embodiment the three transducing units are coaxially arranged, but if necessary, they may be multi-axially arranged by shifting their centers relative to one another. Further, it is noted that while the peripheral edge portions of the speaker diaphragms 8, 9, 10 are shown as being free in FIG. 3, the peripheral edge of the outermost diaphragm 10 may be coupled to the peripheral edge of the speaker frame 1.

Figure 4:
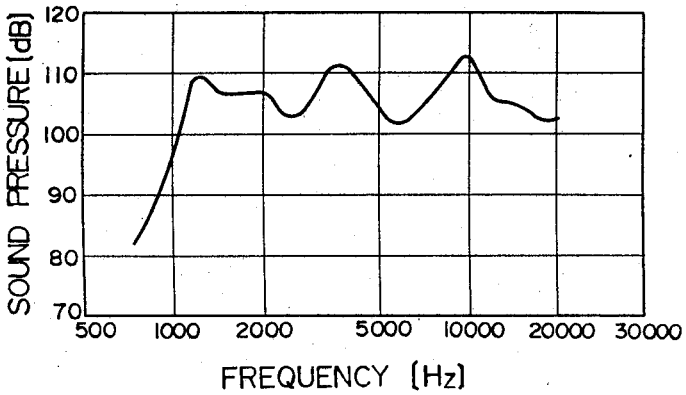
FIG. 4 is a graph showing by way of example the frequency characteristics of the speaker illustrated in FIG. 3.
Figure 5:
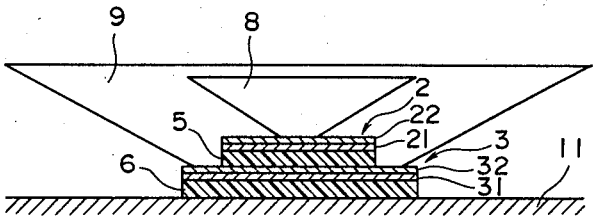
FIGS. 5 and 6 are schematic sectional views illustrating other embodiments of the invention wherein an assembly of transducing units is secured to a baffle board, there being no speaker frame provided.

In FIG. 4 there are shown by way of example frequency characteristics of the speaker illustrated in FIG. 3. A comparison of the graphical representation with that in FIG. 2 can tell clearly that the speaker of this invention has good advantage. Principal aspects of the specifications of piezoelectric elements 2, 3, 4 and of diaphragms 8, 9, 10 are as follows:

Piezoelectric element 2
- Diameter: 14 mm
- Thickness: 230 μm
- Resonant frequency: 8.3 kHz
- Resonant resistance: 150Ω or below
- Electrostatic capacity: 62 nF Diaphragm 8
- Outer diameter (at larger opening): 20 mm Piezoelectric element 3
- Diameter: 28 mm
- Thickness: 230 μm
- Resonant frequency: 3.6 kHz
- Resonant resistance: 150Ω or below
- Electrostatic capacity: 95 nF Diaphragm 9
- Outer diameter (at larger opening): 38 mm Piezoelectric element 4
- Diameter: 42 mm
- Thickness: 230 μm
- Resonant frequency: 1.8 kHz
- Resonant resistance: 150Ω or below
- Electrostatic capacity: 125 nF Diaphragm 10
- Outer diammeter (at larger end): 80 mm FIG. 5 shows another embodiment of the invention, wherein the speaker comprises two transducing units, one consisting essentially of a disc shaped piezoelectric element 2 having a relatively small diameter, a cushioning member 5, having similar shape and diameter bonded thereto, and a relatively small speaker diaphragm (cone) 8 coupled at its smaller opening to the element 2, the other transducing unit consisting essentially of a disc-shaped piezoelectric element 3 having a relatively large diameter, a cushioning member 6 having similar shape and diameter bonded thereto, and a relatively large speaker diaphragm 9 coupled at its smaller place section to the element 3, the first mentioned transducing unit being mounted on the element 3. The underside of the cushioning member 6 is bonded to a baffle plate 11 and the peripheral edge of the larger diaphragm 9 is left free.

Figure 6:
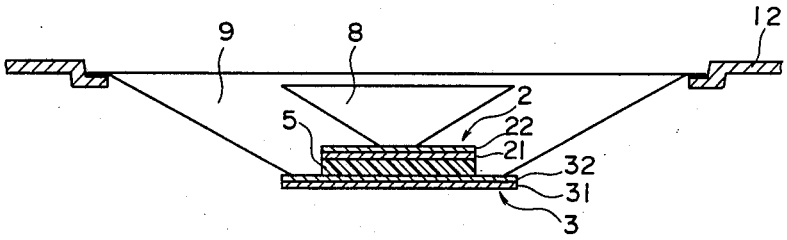

FIG. 6 shows an embodiment in which the assembly is mounted to a baffle board 12 with a hole. The speaker comprises a disc-shaped small-diameter piezoelectric element 2, a cushioning member 5 and a disc-shaped large-diameter piezoelectric element 3, bonded one to another, a small diaphragm 8 and a large diaphragm 9 coupled to the piezoelectric elements 2 and 3 respectively into two transducing units, the assembly so formed being connected only at the peripheral edge portion of the large diaphragm 9 to the peripheral edge of the hole of a baffle board 12.

The embodiments shown in FIGS. 5 and 6 have the advantage that a saucer-shaped frame is not required. Another advantage is that the transducing units are of lightweight construction so that there is no difficulty involved with respect to their strength and acoustical performance notwithstanding the absence of frame. Moreover, the arrangements shown, and more particularly that of FIG. 5, are subject to no limitation whatsoever as to mounting and therefore available for a wide variety of uses.

Figure 7:
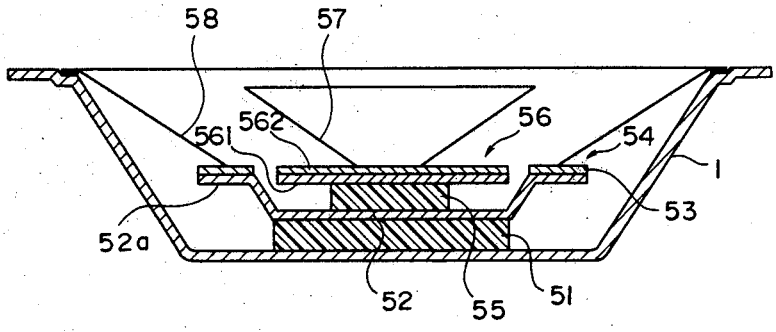
FIG. 7 is a schematic view in section of another embodiment of the invention employing disc and annular piezoelectric elements.

FIG. 7 shows another embodiment of the invention. A cushioning member 51 is bonded to the interior bottom of a saucer-shaped speaker frame 1 at the center thereof, and to the top of the cushioning member 51 is concentrically coupled a metal support member 52 on its flat bottom side. The support member 52 has a saucer shape similar to that of the frame 1; therefore, it has a hollow space at its middle. More concretely, the support member 52 has a peripheral edge portion **52*a*, which has a flat annular configuration, and also has a flat bottom portion at its center. A thin layer of piezoelectric material 53 is bonded to the face of the annular peripheral portion 52*a*, whereby an annular piezoelectric element 54 is formed. There are disposed electrodes (not shown) on the piezoelectric material 53 so that acoustic signals can be given between the electrodes and the support member 52 to drive the piezoelectric element 54. A cushioning member 55 is bonded to the interior flat surface (i.e. inner bottom) of the support member 52, on top of the cushioning member 55 there is mounted a disc-shaped piezoelectric element 56. The thickness of the cushioning member 55 is adapted so that piezoelectric elements 54 and 56 are positioned on the same plane. The element 56 comprises a metal base 561 and a thin layer of piezoelectric material 562 bonded thereto, the latter on the top side, designed so that acoustic signals are given between the metal base 561 and electrodes (not shown) disposed on the piezoelectric material 562**.

A relatively small-size speaker diaphragm (cone) 57 is concentrically coupled at its smaller opening to the face of the piezoelectric element 56, and similarly, a relatively large-size speaker diaphragm 58 is concentrically coupled at its smaller opening to the face of the element 54, thus two transducing units being constituted which are coaxially arranged. If the smaller diaphragm 57 is of full-cone configuration, it is connected at its apex to the element 56, as already described. The peripheral edge portion of the larger diaphragm 58 is fixed to the peripheral edge portion of the frame 1 as shown, or if desired, may be left free. In this embodiment, as well as in other embodiments already described, the two transducing units are acoustically insulated from each other by means of the cushioning member 55, and further from the frame 1 by means of the cushioning member 51. Therefore, they will never affect each other under the vibrations they produce respectively and they faithfully reproduce sound of such ranges as may correspond to their respective resonant frequencies. Thus, a speaker having a wide band coverage can be obtained.

In this embodiment, the piezoelectric elements 54 and 56 are positioned on the same plane, so that the regenerative phases of the two transducing unit may be matched. Coaxial arrangement of the transducing units is advantageous in respect of acoustic image focusing. It goes without saying, however, that the units may be biaxially or multiaxially arranged, if so required. It is also possible to construct independently piezoelectric element 54 for the larger diaphragm 58 without utilizing any portion of the support member 52.

Figure 8:
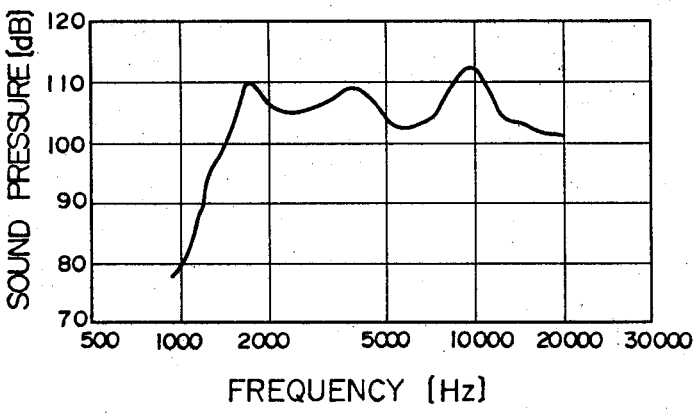
FIG. 8 is a graph showing by way of example the frequency characteristics of the speaker illustrated in FIG. 7.

FIG. 8 is a graphical representation showing by way of example the frequency characteristics of a speaker having the FIG. 7 construction.

Figure 1:
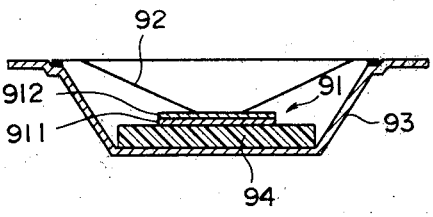
FIG. 1 is a schematic illustration in section of a piezoelectric speaker of conventional type.
Figure 2:
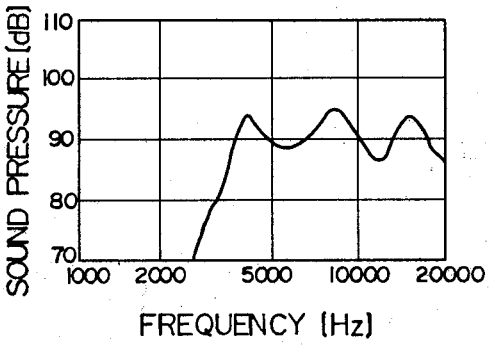
FIG. 2 is a graph showing by way of example the frequency characteristics of the conventional speaker in FIG. 1.

The main aspects of the specifications of piezoelectric elements 54, 56 and diaphragms 57, 58 are as follows:

Piezoelectric element 54
- Outer dia. 27 mm
- Thickness: 230 μm
- Resonant frequency: 25 kHz
- Resonant resistance: 150Ω or below
- Electrostatic capacity: 130 nF Diaphragm 58
- Outer diameter (at larger opening): 50 mm Piezoelectric element 56
- Diameter: 21 mm
- Thickness: 230 μm
- Resonant frequency: 3.85 kHz
- Resonant resistance: 150 or below
- Electrostatic capacity: 130 nF Diaphragm 57
- Outer diameter (at larger opening): 34 mm A comparison of the characteristics shown with those in FIG. 2 clearly indicates that the speaker of this invention provides a notably wide range.

It is noted that the resonant frequency of a piezoelectric element is proportional to not only its diameter or outer diameter, but to its thickness as well. Further, it is known that the sound pressure level is in proportion to the electrostatic capacity value of the piezoelectric material and that a piezoelectric element of the bimorph type, which comprises thin layers of piezoelectric material bonded to both sides of a metal base, will show a higher sound pressure level than a unimorph-type piezoelectric element which, as in the described embodiments, comprises a thin layer of piezoelectric material bonded to only one side of a metal base. Therefore, it is possible to design and construct a composite speaker of present invention having any desired frequency and output characteristics taking these facts into consideration.

Figure 9:
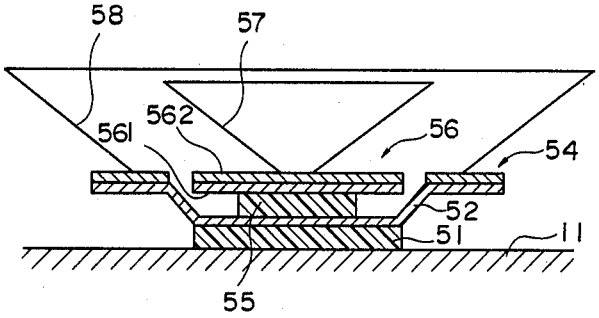
FIGS. 9 and 10 are schematic sectional views showing further embodiments of the invention in which a baffle board is used for mounting purpose, there being no speaker frame provided.

FIG. 9 shows an embodiment in which the outer transducing unit is mounted on a flat baffle board 11. Cushioning member 51 bonded to the underside of support member 52 is attached to the baffle board 11, the edge portion of the outer speaker diaphragm 58 being left free.

Figure 10:
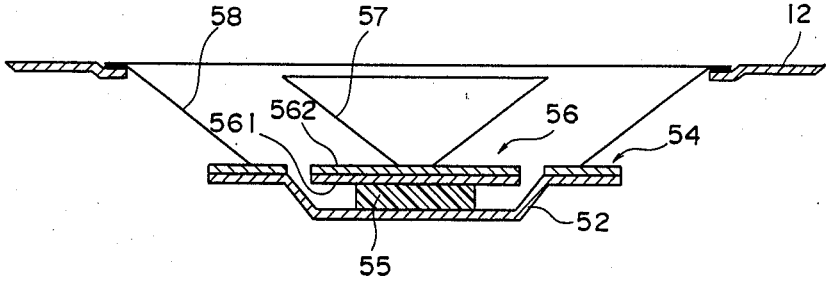

Referring to FIG. 10, there is shown a modified embodiment, in which the outer transducing unit is mounted to a baffle board 12 with a hole. The outer diaphragm 58 coupled to the annular element 54 is connected at its peripheral edge portion only to the peripheral edge portion of the hole of the baffle 12.

The speaker of this invention is lighter in weight as compared with dynamic speakers having a magnetic circuit and a voice coil. With the FIGS. 9 and 10 embodiments, as well as those in FIGS. 5 and 6, there is no problem whatsoever in respect of strength and acoustic performance. They do not require a saucer-shaped frame 1. The one shown in FIG. 9 may be available for versatile uses without limitation as to mounting.

Figure 11:
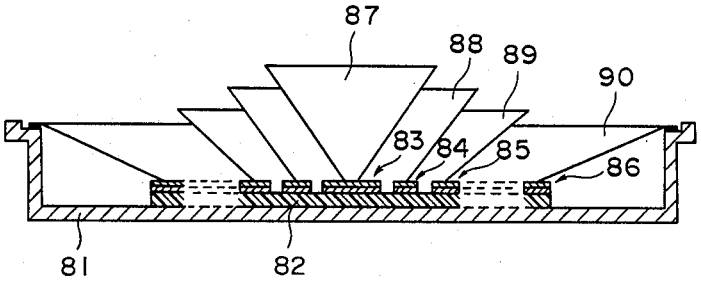
FIG. 11 is a schematic representation in section of another embodiment of the invention wherein a plurality of piezoelectric elements are bonded to a cushioning member.

A further embodiment is shown in FIG. 11. Constructed as a speaker having three and more sets of piezoelectric elements and speaker diaphragms, it provides a much wider band coverage and improved phase characteristics. The cushioning member is arranged in one layer so that the overall thickness is limited.

More concretely, the arrangement is such that a cushioning member 82 is bonded to the interior bottom of an open-type shallow frame 81 having a tube-like shape and on the cushioning member 82 there are mounted a disc-shaped piezoelectric element 83 and annular piezoelectric element 84, 85 . . . 86 in that order outwardly from the center and concentrically with the frame 81. The individual piezoelectric elements 83–86 have different diameters, both inner and outer, and are suitably spaced apart from one another so that they are prevented from being acoustically affected by one another. Speaker diaphragms (cones) 87, 88, 89 . . . 90 having different diameters are concentrically arranged, with their respective smaller end connected to the elements 83, 84, 85 . . . 86 respectively. The outermost diaphragm 90 may be coupled to the edge of the frame 81 as shown or its edge may be left free. The edges of the inner diaphragms 87, 88, 89 . . . are all left free. The above described arrangement provides a wide band coverage. Further, the single cushioning member permits a multiple piezoelectric elements arrangement; this advantage is particularly significant from the standpoint of manufacturing operation.

As is the case with the earlier described embodiments, the individual transducing units comprising piezoelectric elements 83 . . . and speaker diaphragms 87 . . . connected respectively thereto may be coaxially arranged as shown, or multi-axially arranged, with their centers different from one another. The cushioning member 82 may be bonded directly to a baffle board, in which case frame 81 can be dispensed with; and the outermost cone 40 may be connected to the peripheral edge of a hole of a baffle board.

As this invention may be embodied in several forms without departing from the spirit of essential characteristics thereof, the present embodiement is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. A multiple speaker comprising a plurality of transducing units, each including a speaker diaphragm having a diameter different from that of the counterpart in another transducing unit and a piezoelectric element connected to the smaller end portion or apex of the speaker diaphragm, the individual piezoelectric elements being securely placed one upon another, with a cushioning member interposed between each two adjacent piezoelectric elements, so that the transducing units are coaxially or multi-axially arranged.

2. A multiple speaker as set forth in claim 1, wherein the piezoelectric elements are disc-shaped.

3. A multiple speaker as set forth in claim 1, wherein the diametral sizes of the individual piezoelectric elements are substantially proportional to those of the individual speaker diaphragms connected thereto, said piezoelectric elements being mounted one on another in order of diametral size, the smallest one on the top side.

4. A multiple speaker as set forth in claims 1, 2 or 3, wherein the piezoelectric element whose diameter is largest of all is secured to a speaker frame, with a cushioning member interposed between.

5. A multiple speaker as set forth in claims 1, 2 or 3, wherein the piezoelectric element whose diameter is largest of all is secured to a baffle plate, with a cushioning member interposed between.

6. A multiple speaker as set forth in claims 1, 2 or 3, wherein only the transducing unit having the largest-diameter speaker diaphragm is secured to a baffle board with a hole in such a way that the peripheral edge of the speaker diaphragm at its larger opening is connected to the edge portion of said hole.

7. A multiple speaker comprising a first transducing unit having a first piezoelectric element and a first speaker diaphragm connected at its smaller end or apex to the face of the first piezoelectric element, one or more second transducing units each having a second piezoelectric element and a second speaker diaphragm connected at its smaller end to the face of the second piezoelectric element, said second piezoelectric element having an annular configuration and an inner diameter larger than the diameter of said first piezoelectric elements, said second speaker diaphragm having a larger diameter than said first speaker diaphragm, said second piezoelectric element being disposed on the peripheral rim portion of a support member, a cushioning member being interposed between said first piezoelectric element and said support member and/or between said support member and another support member of similar shape, said transducing units being coaxially or multiaxially arranged.

8. A multiple speaker as set forth in claim 7, wherein said first piezoelectric element has a disc-shape.

9. A multiple speaker as set forth in claim 7, wherein said support member has a hollow space in the middle, a cushioning member being disposed in said hollow space so that a plurality of piezoelectric elements are arranged on substantially the same plane.

10. A multiple speaker as set forth in claims 7, 8 or 9, wherein said support member is fixed to a speaker frame, with a cushioning member interposed between.

11. A multiple speaker as set forth in claims 7, 8 or 9, wherein said support member is secured to a baffle board, with a cushioning member interposed between.

12. A multiple speaker as set forth in claims 7, 8 or 9, wherein only the outermost one of said second transducing units is secured to a baffle board with a hole in such a way that the peripheral edge of its speaker diaphragm at the larger opening thereof is connected to the edge portion of said hole.

13. A multiple speaker comprising a first transducing unit having a first piezoelectric element and a first speaker diaphragm connected at its smaller end or apex to the face of the first piezoelectric element, one or more second transducing units each having a second piezoelectric element and a second speaker diaphragm connected at its smaller end or apex to the face of the second piezoelectric element, said second piezoelectric element having an annular configuration and a larger inner diameter than the diameter of said first piezoelectric element, said second speaker diaphragm having a larger diameter than said first speaker diaphragm, the individual piezoelectric elements being securely mounted on a cushioning member in spaced apart relation to one another, said transducing units being coaxially or multi-axially arranged.

14. A multiple speaker as set forth in claim 13, wherein said cushioning member is fixed to a speaker frame.

15. A multiple speaker as set forth in claim 13, wherein said cushioning member is fixed to a baffle board.

16. A multiple speaker as set forth in claim 13, wherein only the outermost one of said second transducing units is secured to a baffle board with a hole in such a way that the peripheral edge of its speaker diaphragm at the larger opening thereof is connected to the edge portion of said hole.

* * * * *